US006676278B2

(12) United States Patent
Striebel et al.

(10) Patent No.: US 6,676,278 B2
(45) Date of Patent: Jan. 13, 2004

(54) SUPER BRIGHT LED UTILITY AND EMERGENCY LIGHT

(75) Inventors: Roman F. Striebel, Duxbury, MA (US); Donald McLeish, Berkeley, CA (US)

(73) Assignee: Suncor Stainless, Inc., Plymouth, MA (US)

( * ) Notice: Subject to any disclaimer, the term of this patent is extended or adjusted under 35 U.S.C. 154(b) by 0 days.

(21) Appl. No.: 09/968,560

(22) Filed: Oct. 1, 2001

(65) Prior Publication Data

US 2002/0075683 A1 Jun. 20, 2002

Related U.S. Application Data

(60) Provisional application No. 60/237,012, filed on Sep. 29, 2000.

(51) Int. Cl.[7] ..... F21V 29/00

(52) U.S. Cl. ..... 362/267; 362/158; 362/198

(58) Field of Search ..... 362/158, 184, 362/198, 267, 399, 309, 800, 362

(56) References Cited

U.S. PATENT DOCUMENTS

| | | | | | |
|---|---|---|---|---|---|
| 4,152,624 | A | | 5/1979 | Knaebel | 313/499 |
| 4,190,976 | A | | 3/1980 | Hurt | 43/17.5 |
| 4,574,337 | A | | 3/1986 | Poppenheimer | 362/267 |
| 4,597,033 | A | | 6/1986 | Meggs et al. | 1362/183 |
| 4,744,014 | A | | 5/1988 | Harris | 362/145 |
| 4,758,934 | A | | 7/1988 | von Kohorn | 362/145 |
| 5,036,442 | A | | 7/1991 | Brown | 362/102 |
| 5,068,773 | A | | 11/1991 | Toth | 362/386 |
| 5,083,192 | A | | 1/1992 | Rzeznik et al. | 357/74 |
| 5,130,909 | A | | 7/1992 | Gross | 362/153 |
| 5,211,469 | A | | 5/1993 | Matthias et al. | 362/101 |
| 5,222,799 | A | | 6/1993 | Sears et al. | 362/146 |
| 5,264,997 | A | | 11/1993 | Hutchisson | 362/226 |
| 5,349,509 | A | * | 9/1994 | Klug | 362/362 |
| 5,632,551 | A | | 5/1997 | Roney et al. | 362/249 |
| 5,771,617 | A | | 6/1998 | Baker | 40/544 |
| 5,842,779 | A | * | 12/1998 | Siebert | 362/309 |
| 5,876,109 | A | | 3/1999 | Scalco | 362/104 |
| 5,927,845 | A | | 7/1999 | Gustafson et al. | 362/152 |
| 6,069,447 | A | * | 5/2000 | Vilanilam et al. | 362/800 |
| 6,135,621 | A | * | 10/2000 | Bach et al. | 362/399 |
| 6,241,361 | B1 | * | 6/2001 | Thrasher et al. | 362/267 |

* cited by examiner

*Primary Examiner*—Alan Cariaso
*Assistant Examiner*—Bao Truong
(74) *Attorney, Agent, or Firm*—Perkins Smith & Cohen LLP; Jacob N. Erlich; John A. Hamilton

(57) ABSTRACT

The present invention provides a miniature lighting system which is durable, inexpensive and yet versatile. The lighting system has a light source and electrical component assembly located within a housing. The electrical component assembly is surrounded by a sealant in order to prevent any water or moisture from reaching the electrical connections and to permanently seal and unitize the circuitry with the housing. The housing is shaped so as to surround and protect the light source without allowing the sealant to reach or coat the light source.

20 Claims, 18 Drawing Sheets

SUPER BRIGHT LED UTILITY AND EMERGENCY LIGHT

CROSS REFERENCE TO RELATED PATENT APPLICATIONS

This application claims priority of U.S. Provisional Application Serial No. 60/237,012 entitled SUPER BRIGHT LED UTILITY AND EMERGENCY LIGHT, filed Sep. 29, 2000, the provisional application being incorporated herein by reference.

FIELD OF THE INVENTION

The present invention relates generally to lighting and, more particularly, to emergency lighting and other illumination lighting applications.

BACKGROUND OF THE INVENTION

Miniature illumination lighting devices have historically used incandescent or halogen bulbs. The problem with these kinds of lighting systems is they are relatively inefficient. A substantial amount of energy is lost generating heat as a byproduct. Another disadvantage of these types of systems is the relatively short life span of the bulbs. Consequently, these lighting systems require high operational and maintenance costs.

Presently, light-emitting diode (LED) devices have primarily been used as panel lights or circuit status indicators. Other uses for LEDs can be found in the following U.S. Pat. Nos. 5,211,469, 5,130,909, 4,744,014, 4,758,934, 5,083,192, and 5,222,799. Present lights, even if they use LED devices, are manufactured and sold for a specific purpose, such as concentrated to a point of light for assembly work in the high technology industry or use in aquariums. Additionally, these lights typically require special housings, brackets, circuit boards, or the like. Since these lights are constructed and designed for one specific purpose, they are either too expensive or impossible to adapt to other uses.

Therefore, there is a need for an individual component, compact lighting system, which is easy to manufacture, install and maintain. There is also a need for a lighting system which is durable, so that the light will last a very long time without maintenance even if constantly exposed to the elements, and easily adaptable so that it may be used with many existing components such as photo cells, solar energy panels, DC converters and the like. Furthermore, there is a need for a versatile lighting system so that additional uses in the general fields of the applications may be accomplished without undue expense or effort.

It is therefore an object of the present invention to provide a miniature lighting system, which is durable, inexpensive, easily accessible, relatively maintenance free and capable of being used under emergency conditions.

It is a further object of the present invention to provide a miniature lighting system having low installation and operational costs.

It is still a further object of the present invention to provide a versatile lighting system which is easily combined with other lights or other lighting components in a production setting or by most consumers.

SUMMARY OF THE INVENTION

The objects set forth above as well as further and other objects and advantages of the present invention are achieved by the embodiments of the invention described herein below.

The present invention provides a miniature lighting system which is durable, inexpensive and yet versatile. The lighting system has a light source and electrical component assembly located within a housing. The electrical component assembly is surrounded by a sealant in order to prevent any water or moisture from reaching the electrical connections and to permanently seal and unitize the circuitry with the housing. The housing is shaped so as to surround and protect the light source without allowing the sealant to reach or coat the light source.

The primary use of the present invention is for illumination in pleasure or commercial marine applications, in residential and commercial building applications such as emergency lighting and railings, in landscaping applications such as gardens, walkways and driveways, in vehicle applications, and in corrosive industrial environment applications such as mining.

Other aspects of the present invention will become more fully apparent from the following detailed description of the preferred embodiments, the accompanying drawings and the appended claims.

DETAILED DESCRIPTION OF THE PREFERRED EMBODIMENTS

Figure 1:
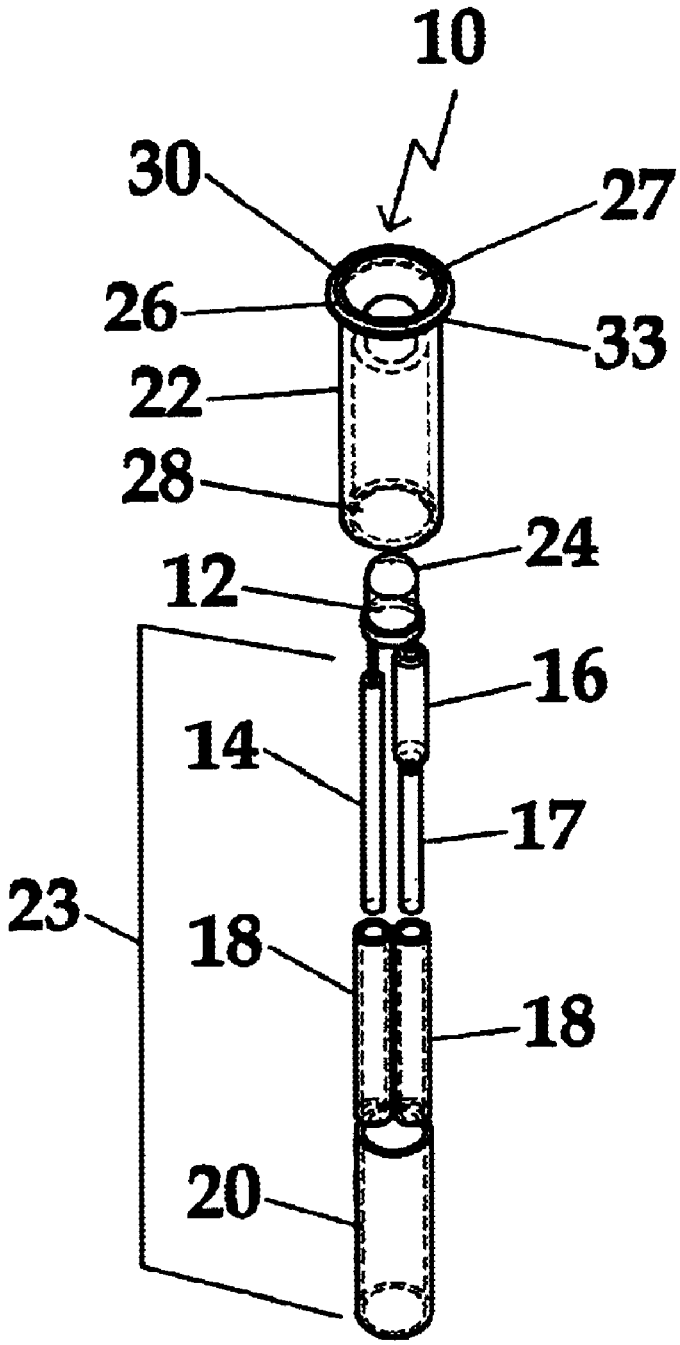
FIG. 1 is an exploded pictorial view of a lighting system of this invention.
Figure 2:
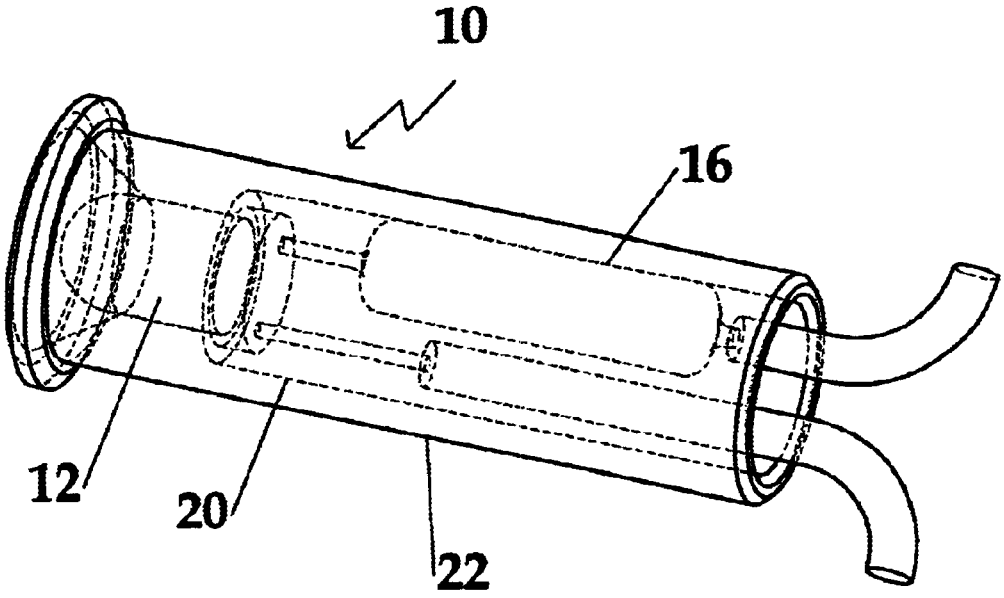
FIG. 2 is a pictorial side view of an assembled lighting system of this invention.

Referring to FIGS. 1 and 2, one embodiment of the lighting system 10 of the present invention includes a bright white LED 12, an electric insulated wire having a negative lead 14 connected to the LED 12, a resistor 16 connected to the LED 12, and an electric insulated wire having a positive lead 17 connected to the resistor 16. The resulting connections are then each covered by a small, inner piece of shrink-tube 18 after which the complete component assembly 23 is covered by an outer shrink-tube 20, which all together prevent any electrical component from touching a housing 22, preferably made of stainless steel although nonmetallic housings can also be used.

The electrical component assembly 23 is then inserted into the housing 22. One embodiment of the housing 22 comprises of a top portion 26, which includes a flat area 30, an inside chamfered surface 27 and a housing shoulder 33, and a bottom portion 28. The housing 22 is stepped in such a way that only the dome 24 of the LED fits through the top portion of the housing 26 and the electrical component assembly 23 is contained in the bottom portion of the housing 28. Once inside the housing 22, the assembly 23 is surrounded with a commercially available sealant 70 such as epoxy or silicon sealer to prevent any water or moisture from reaching the resistor 16 or connections, but without the sealant 70 being able to reach or coat the LED 12 lens. Furthermore, the housing 22 is machined so that the top portion of the housing 26 surrounds and protects the LED 12 against damage. Additionally, when using a metal housing 22, the inside chamfered surface 27 and the flat area 30 are polished after machining so as to enhance the reflective light of the LED 12. The finished lighting assembly 10 is connected to a desired power source 72 near the bottom portion of the housing 28 by means of the electrical wires 14, 17.

Figure 3:
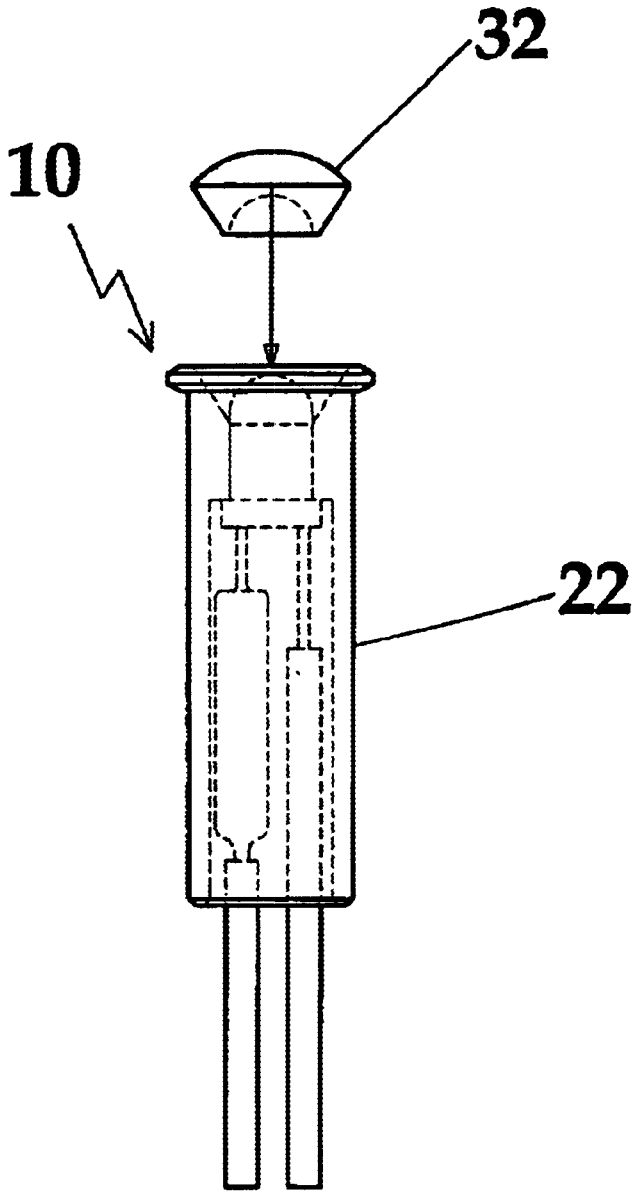
FIG. 3 is a side view of the assembled lighting system of this invention with a cap that permits a diffused light pattern.

Referring also to FIG. 3, in one embodiment of the lighting system 10, a machined or injection molded cap or diffusing lens 32 may be affixed to the top portion 26 of the housing 22, thus providing a "softer", diffused light source and wide-angle coverage as opposed to the point of light generated by the uncovered LED 12.

In another embodiment, the electrical wires 14, 17 may end in an injection-molded plug instead of remaining bare. The lighting system 10 may also include an extension cable of various lengths so that the lighting system 10 can be any distance from the power source. The extension cable may have molded plugs or connectors at each end which are in the opposite configuration to the ones on the lighting system 10, thus allowing an immediate connection in only one possible way. The molded connectors prevent unskilled users from connecting the lighting system 10 in the wrong way potentially damaging the LED lights 12 which are very sensitive to the correct polarity.

Figure 4:
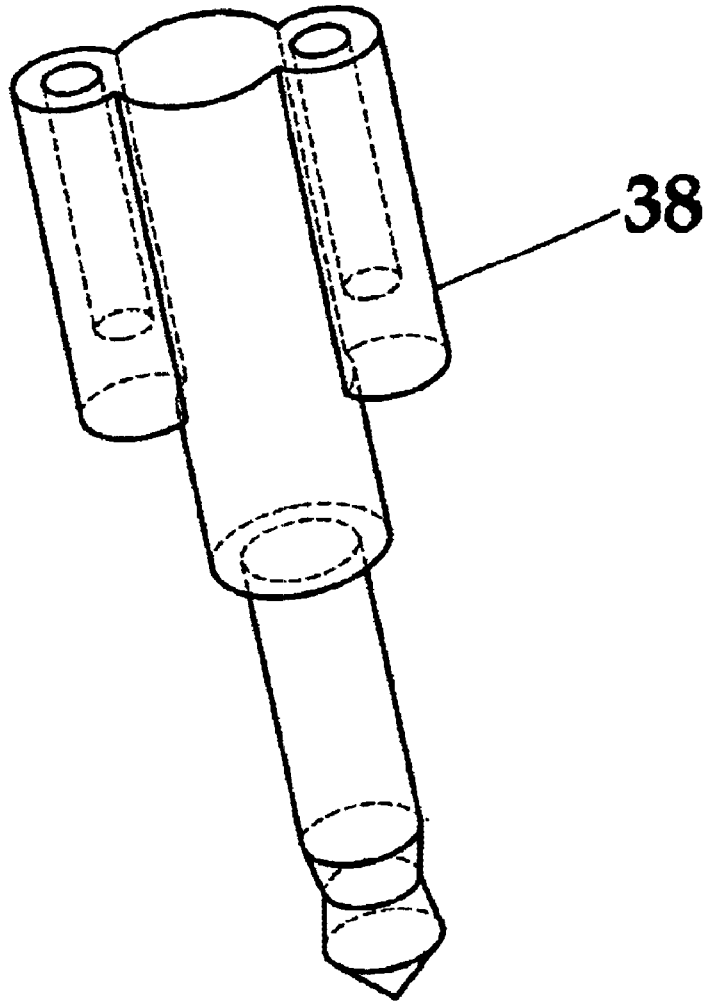
FIG. 4 is a pictorial view of one embodiment of a "Y" connector used with the lighting system of this invention.

Referring to FIG. 4, in another embodiment, the lighting system 10 may include a "Y" connector 38, which has molded plugs on both ends located so each end is able to connect with a lighting system 10 or an extension cable. This "Y" connector 38 is molded complete in a compact size, and serves to attach as many lighting systems 10, or extension cables as required along the way. This is especially useful in building applications, such as railings and emergency lights, as the lighting system 10 can be positioned in any location and can be connected by means of "Y" connectors 38 and extension cables to one single power source 72.

The lighting assembly 10 is then connected to a commercially available power converter, battery, or series of batteries, having a nominal output of either 12 V or 24 V.

A commercially available converter, similar to the ones used on calculators and like items, may be fitted with one male and one female plug so that the finished assembly 10 can be easily connected to such power source 72. The connection of the converter to electric power may also be supplemented with a photocell or timer 74.

The light assembly 10 may be used in many different applications. Since the lighting assembly 10 is very small, the outside diameter of the housing 22 is preferably 6.3 mm (¼"), the assembly 10 can be directly and without other parts mounted in practically any natural and synthetic material, such as wood, fiberglass, glass, metal, stone, plastics, concrete, plasterboard, and other such materials. The housing 22 is simply inserted into a small hole, preferably a drilled ¼" hole, and held there by a sealant, such as epoxy or silicon sealer both of which are widely available.

For mounting in thin metals, such as those encountered in appliances, vehicles or boats, the housing 22 may be held through the means of a standard rubber grommet 42. This requires the drilling of a small hole, preferably a ⅜" or 10 mm hole, into which the grommet 42 is first inserted, thus forming a secure, vibration proof adaptor for the light housing 22. In these applications, the addition of a sealant is no longer required.

Another application of the lighting system 10 is emergency lighting in houses or any other buildings, permanent or temporary, such as hospitals, offices and military installations. Depending on the size of the room, one or more lighting assemblies 10 may be permanently mounted into the walls, preferably approximately 12" from the ceiling, or into the ceiling itself. Such installations generate a brighter light inside the room, since the ceilings reflect the bright white light of the LED 12. A small room may only require one lighting system 10 whereas an average room, such as a 10 ft×10 ft room, may require two or three lighting systems 10. Corridors may require one lighting system 10 every six to eight feet. Although the lighting system 10 of the present invention is probably not bright enough to permit reading in such rooms, the brightness is certainly sufficient to see all objects inside the room, find the doors, windows, beds or other features very easily. When not in use, the lighting systems 10, due to the very small size of their face and being flush with the wall, are hardly noticeable and will not detract from any décor.

Connecting all lighting systems 10 from each room by means of the "Y" connectors 38 and extension cables is easily accomplished since the molded ends simply plug together in a desired configuration resulting in one pair of wires at the end of the assembly 10. For standard or emergency use, the lighting systems 10 may be connected to a standard 12 V car battery or if a very large amount of systems 10 are used, such as in a hospital setting, several 12 V batteries may be connected in parallel. The batteries may then be charged either by a solar charging unit thus completely avoiding any electric power supply or by a suitable, commercially available trickle charger, which keeps the batteries fully charged during the time when electricity is available, for use in electric emergencies.

Since the low power requirements of an LED 12 are well known and are only about 20 milliamps each, very little charging by solar energy is required. Consequently, the lighting assembly 10 lasts a long time on a standard 12 V battery without any recharging. For example, an installation of 20 lights, used only at night but without recharging the battery, took four days to drain the battery thus giving many more hours of use than any existing emergency system, which typically lasts for only a few hours.

In another application, the lighting system 10 may be used to light up any size deck railing in an indirect way thus providing security lighting to see the rail and providing a beautiful accent to the railing itself. The lighting system 10 may be used for any railing whether constructed from square or round tubing, wire rope, wood, metal or other material.

For wooden rails, the lighting system 10 may either be clipped into a small bracket, designed for the application and easily mounted with two screws, or be inserted into a standard length of wood, which has been grooved out on the top to take the extension cable and "Y" connectors 38. In another embodiment, the lighting system 10 may be mounted under the top rail with the light shining down, therefore providing an indirect light on the rail without loss of night vision. The installations of the lighting systems 10 in rails are exceptionally easy and accomplished using simple tools such as a drill, screwdriver, saw and screws.

Another application of the lighting system 10 is lighting for walkways using brick, natural, or concrete paving stones of any shape. In all stone applications, a masonry drill is used to drill a hole through the stone, such as a ¼" hole. A slightly larger drill bit is then used, such as a ⅜" or 10 mm bit, to widen the top end of this hole in such a way that the lighting system 10 sits recessed below the surface of the stone, thus protected from any traffic. As the paving is laid, the lighting system 10 is inserted into pre-drilled stones and is held in place by a sealant. The exposed ends with the molded plugs are then connected by "Y" connectors 38 and extensions cables to each other and eventually to the power source, which can either be activated by a switch 76, photo-eye or timer 74. In such applications, any light pattern design may be possible. The lighting system 10 may illuminate the walkway and surrounding landscaping as well as provide an esthetically pleasing atmosphere.

In another application, the lighting system 10 may be placed into natural stones or rocks, commonly known as washed pebbles, typically about 3" in size. The lighting system 10 is also recessed in the same manner as described for walkway stones, but the pebbles can then be used to light up plants or landscape features in a very natural way.

The lighting system 10 also has wide application in any marine environment. A small number of the lighting systems 10 installed in a cockpit of a boat can illuminate the space or the steps down in such a way as to avoid the loss of night vision. In any cabin, one or more of the lighting systems 10 can provide enough illumination to comfortably use the space such as near bunks, over galley equipment, or as spot or emergency lights in the salon. If the lighting systems 10 are installed inside a commercially available flexible holder, the lighting system 10 can be aimed in any direction. This is especially useful when attached to a rigging, where such lighting systems 10 can illuminate upwards towards the sails, or downwards towards the blocks and other equipment. The exceptionally small, compact size of the lighting systems 10 makes installation feasible even in applications which were not previously accommodated with standard lights such as, but not limited to, confined spaces, anchor wells, radar arches, compartments and more. Since the lighting systems 10 are waterproof and run on very low power, their potential marine applications are very extensive, fulfilling all requirements associated with that field, at negligible use of power, low price and easy installation.

Another application of the lighting system 10 is illuminating in and around vehicles. The lighting system 10 may be mounted into the sides of truck loading beds, into the "roll bars" of vehicles, into tool or other compartments, or into the outside edge of review mirrors thus permitting the illumination of narrow spaces and allowing easier maneuvering of the vehicle. The advantages in these kinds of applications and other similar applications is the lighting system 10 is small, compact, durable, and easily adaptable. For example, the lighting system 10 fits into thin metal materials without any risk of damage, is capable of being mounted flush with the metal, easily adapts to curved surfaces because of the rubber grommet 42 component, is waterproof, and fits into curved surfaces with minimum modification of the housing shoulder 33.

Figure 5A:
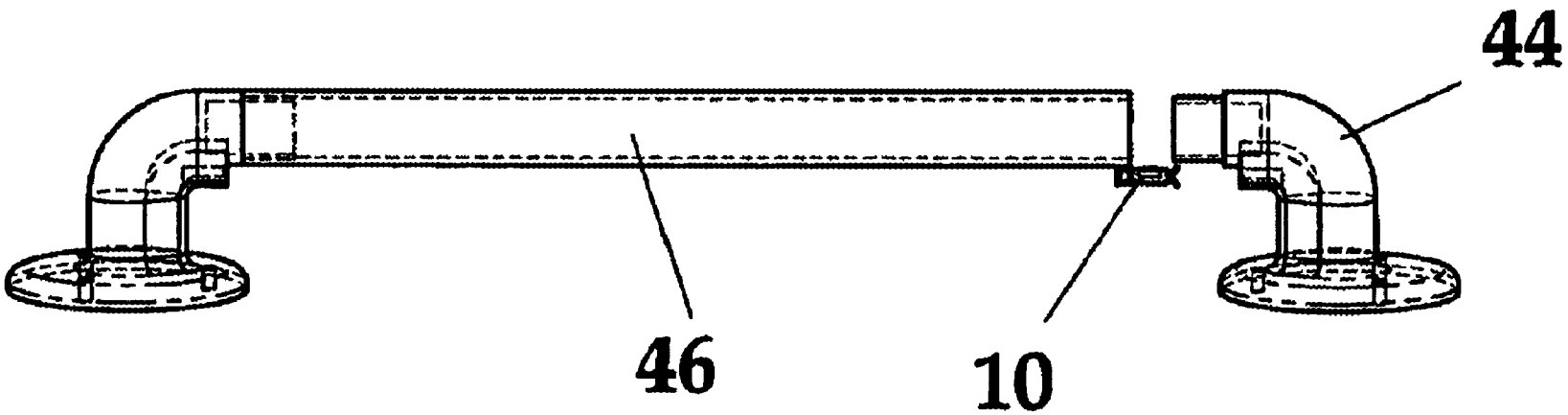
FIG. 5*a* is a pictorial view of the lighting system of this invention mounted within a mounting base of a handrail.
Figure 5B:
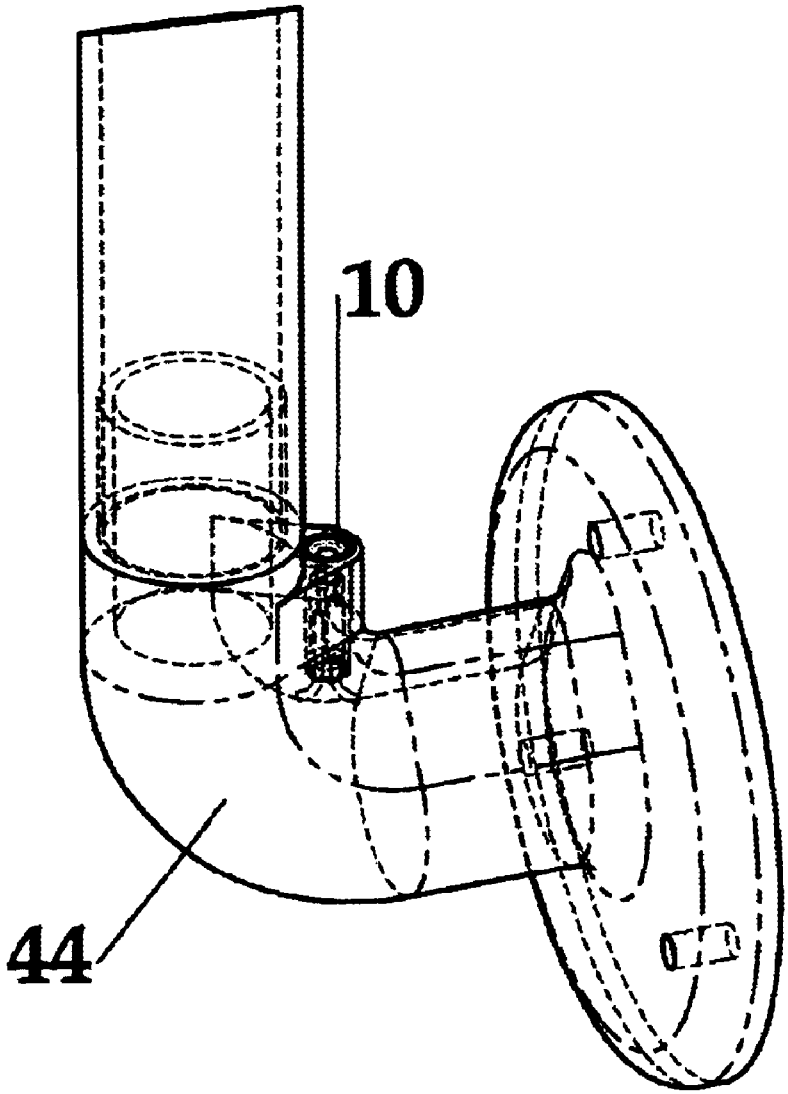
FIG. 5*b* is a partial pictorial view of the lighting system of this invention within the mounting base of the handrail.

Referring to FIGS. 5*a* and 5*b*, the lighting system 10 may be mounted flush into a mounting base 44 on a handrail 46, thus allowing illumination of the handrail 46 without undue interference with its functionality. Potential applications include the lighting of grab bars and other handles such as those associated with ambulance, fire, construction, utility and other standard vehicles. Another advantage of the mounting base 44 is any length of rail 46 may be used as the mounting bases 44 are identical and interchangeable with various lengths of straight tubing.

Figure 6A:
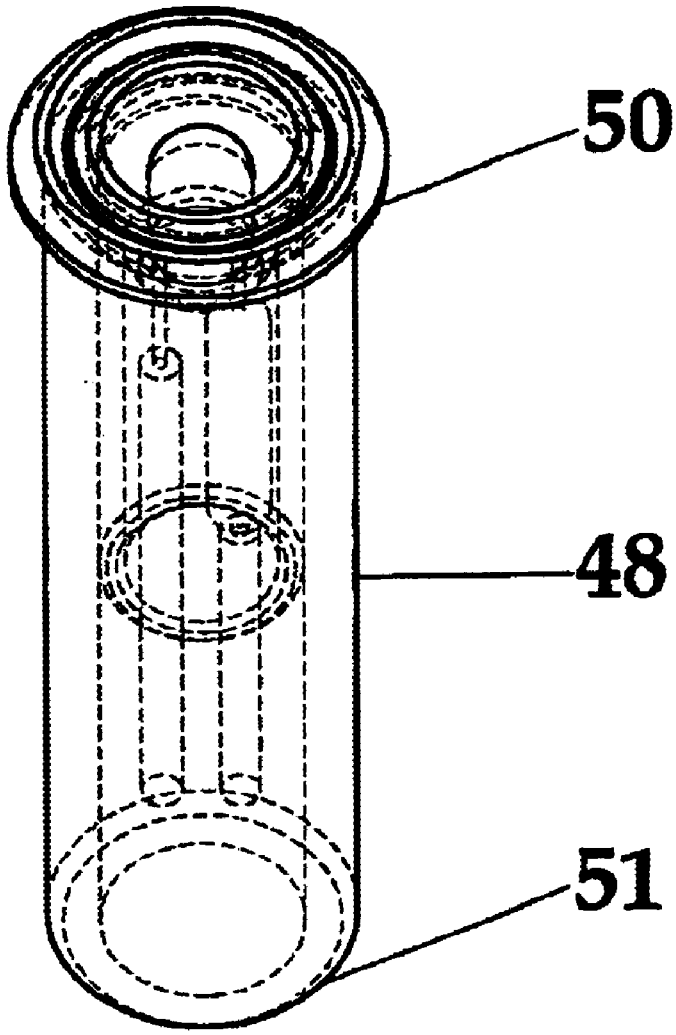
FIG. 6*a* is a pictorial view of the lighting system of this invention flush mounted within an outer housing.
Figure 6B:
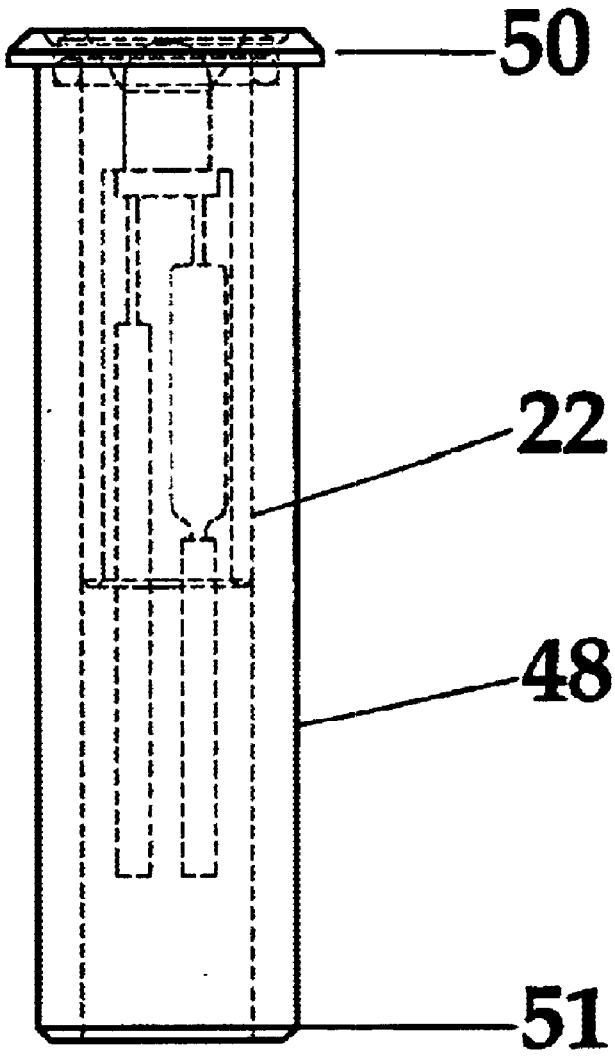
FIG. 6*b* is a side view of the lighting system of this invention flush mounted within an outer housing.
Figure 6C:
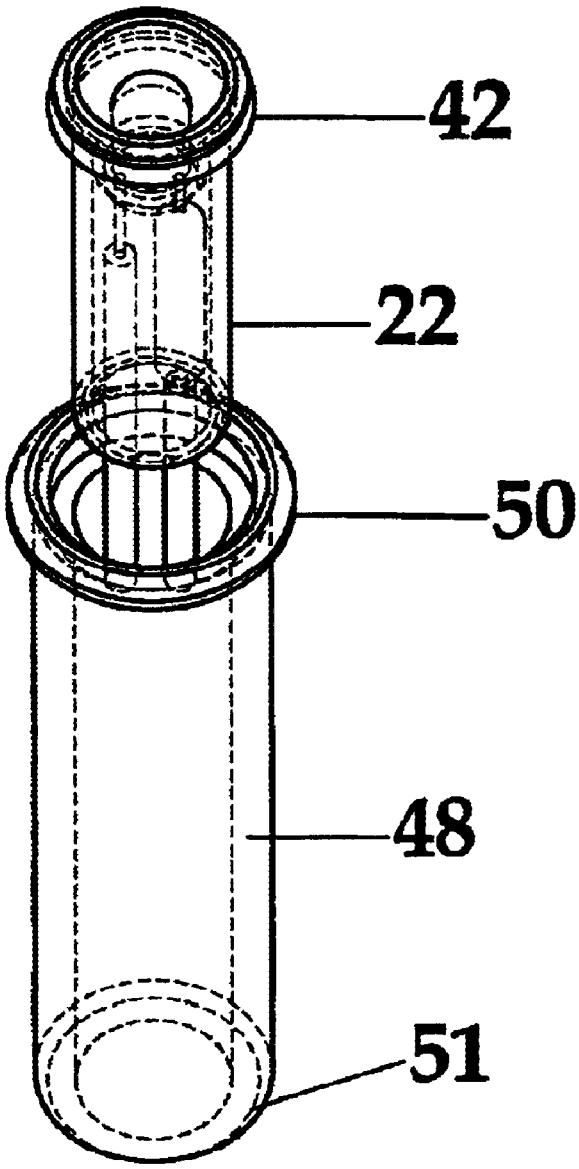
FIG. 6*c* is an exploded pictorial view of the lighting system of this invention flush mounted within an outer housing.

Referring also to FIGS. 6*a*, 6*b*, and 6*c*, the lighting system 10 may also include an outer housing 48 for applications which require the pre-positioning and casting-in of the lighting system 10 as encountered in concrete, plaster, swimming pools, and many other applications requiring cast or poured material. The outer housing 48 consists of a top portion 50 where the housing 22 is inserted, and a bottom portion 51 which is connected to a flexible or rigid conduit before being cast into the surrounding material. Such an arrangement allows all lights to be installed at any time. The outer housing 48 may be made from any material, but preferably stainless steel or plastic.

Figure 7A:
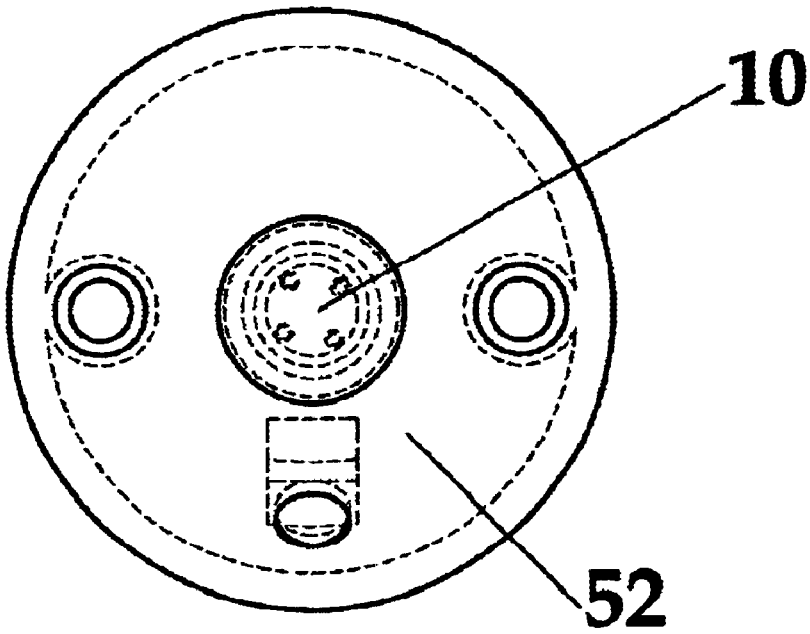
FIG. 7*a* is a pictorial top view of a surface mounted, unitized housing containing several lighting systems of this invention.
Figure 7B:
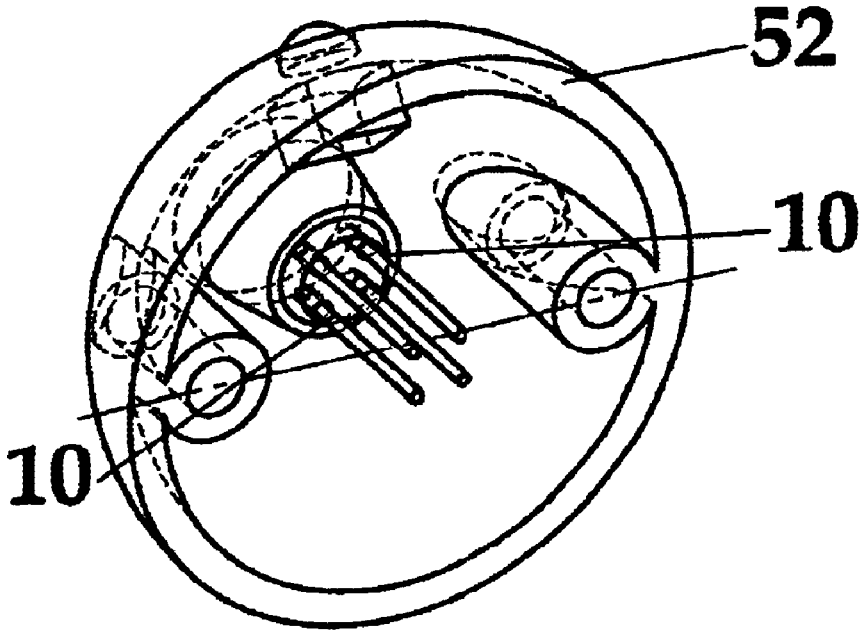
FIG. 7*b* is a pictorial bottom view of a surface mounted, unitized housing containing several lighting systems of this invention.
Figure 7C:
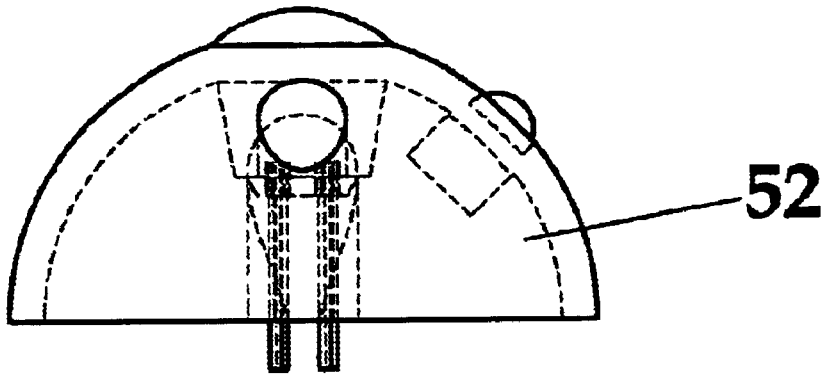
FIG. 7*c* is a pictorial side view of a surface mounted, unitized housing containing several lighting systems of this invention.

Referring to FIGS. 7*a*, 7*b* and 7*c*, the lighting system 10 may also be combined with other lighting systems 10 to provide a stronger illumination. Several lighting systems 10 may be grouped together within a single, unitized, environmentally sealed housing 52. The unitized housing 52 may be surface mounted or recessed and may also include a switch within the unitized housing 52.

Figure 8A:
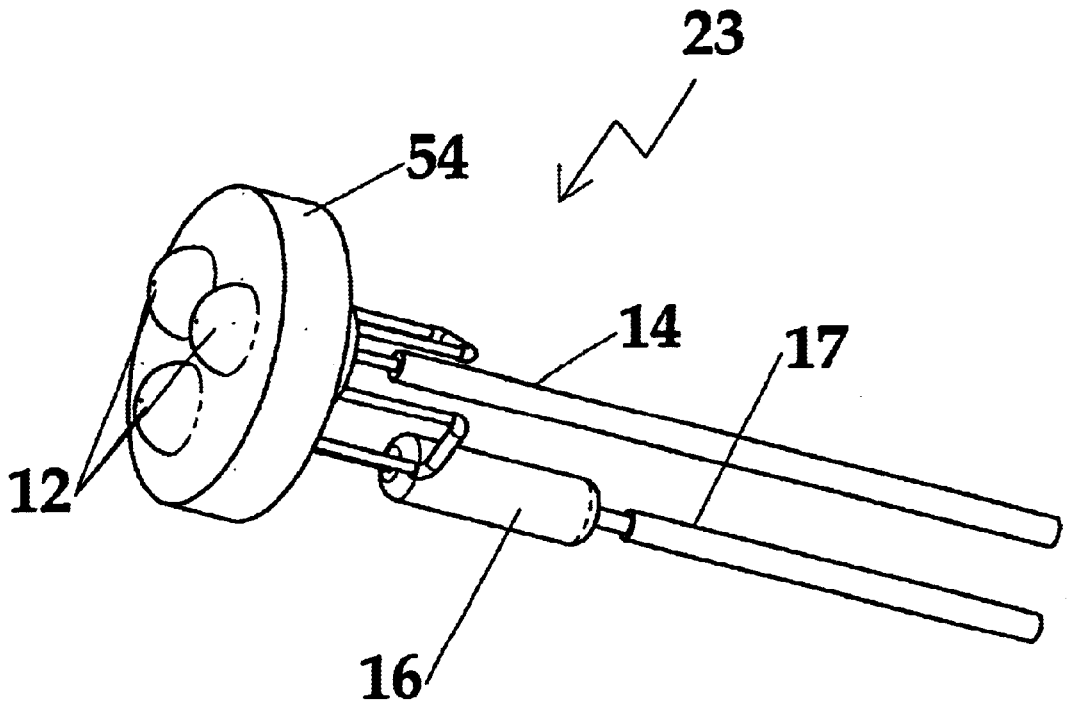
FIG. 8*a* is a pictorial side view of a lighting system of this invention with several LEDs.
Figure 8B:
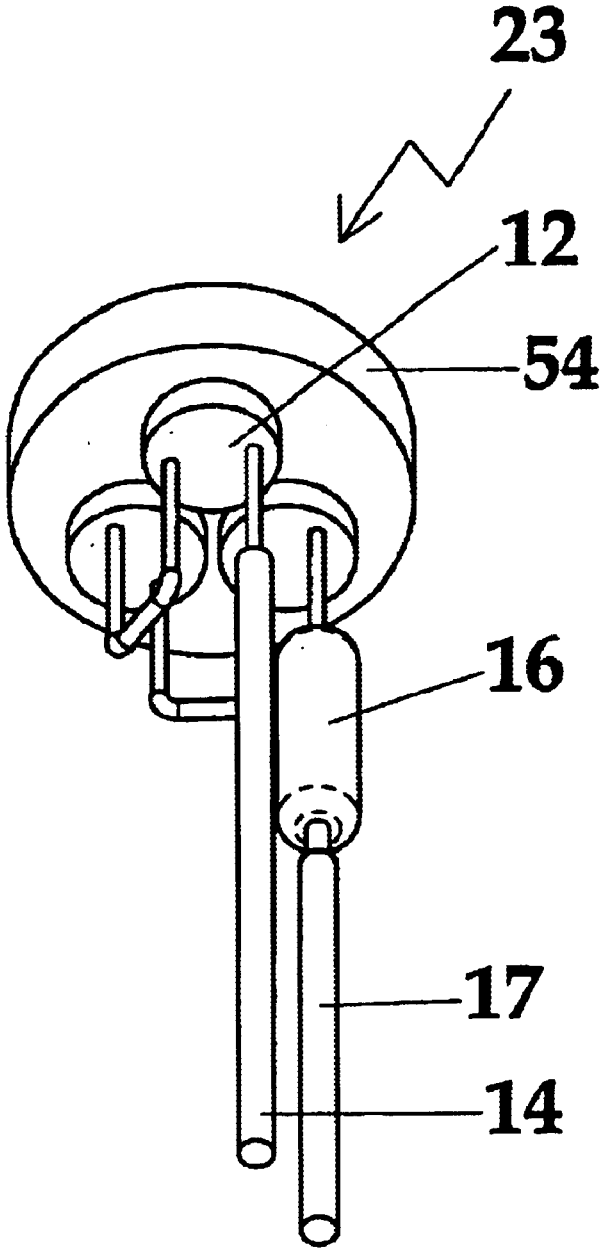
FIG. 8*b* is a pictorial bottom view of a lighting system of this invention with several LEDs.
Figure 9A:
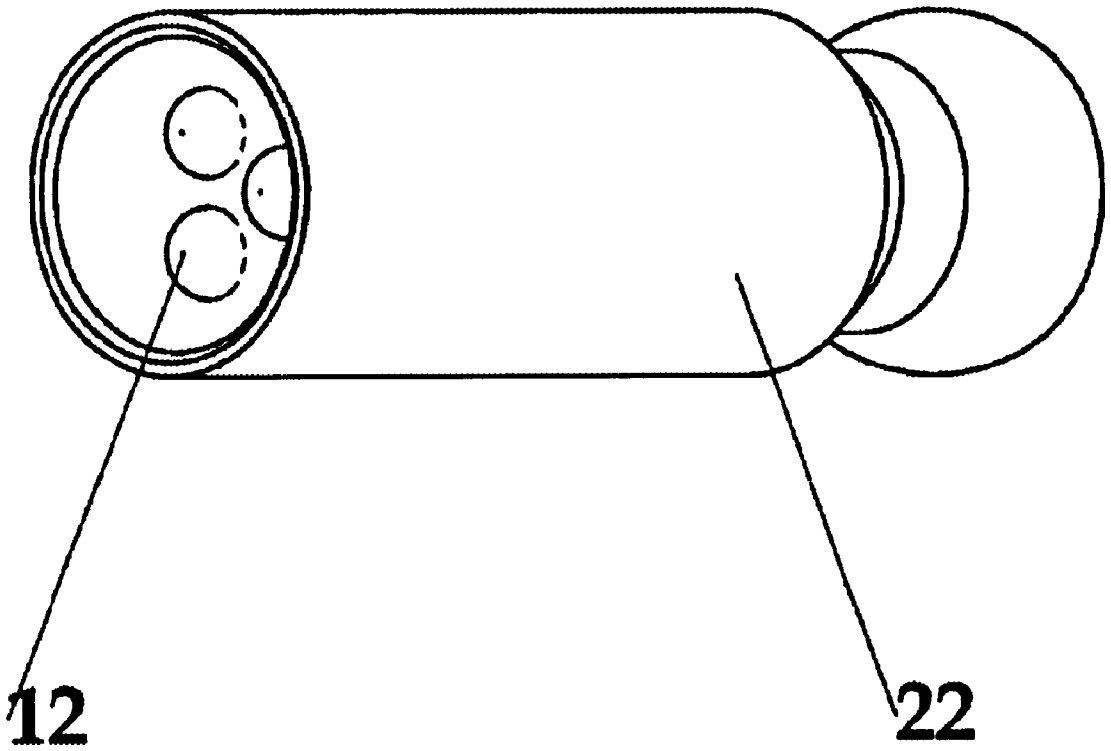
FIGS. 9*a*, 9*b*, and 9*c* are pictorial views of a housing containing a lighting system of this invention with several LEDs.
Figure 9B:
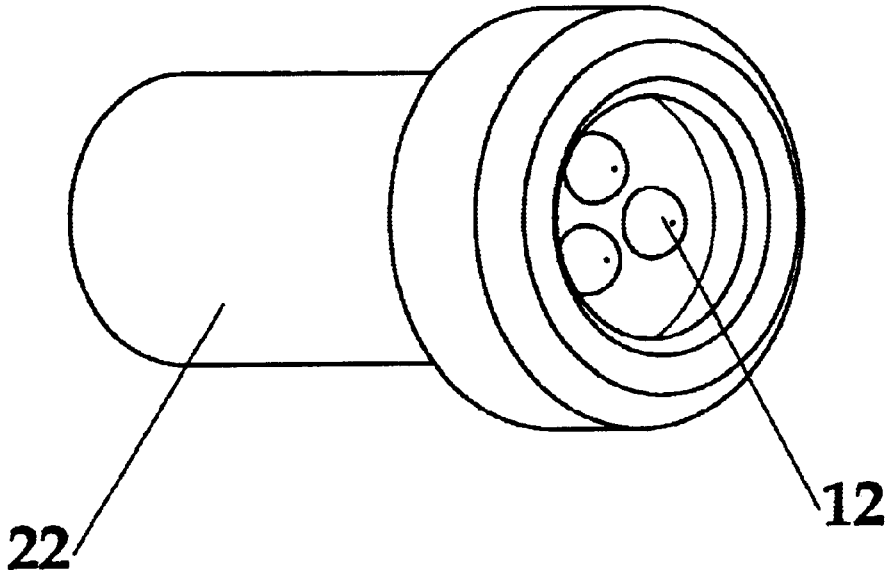
Figure 9C:
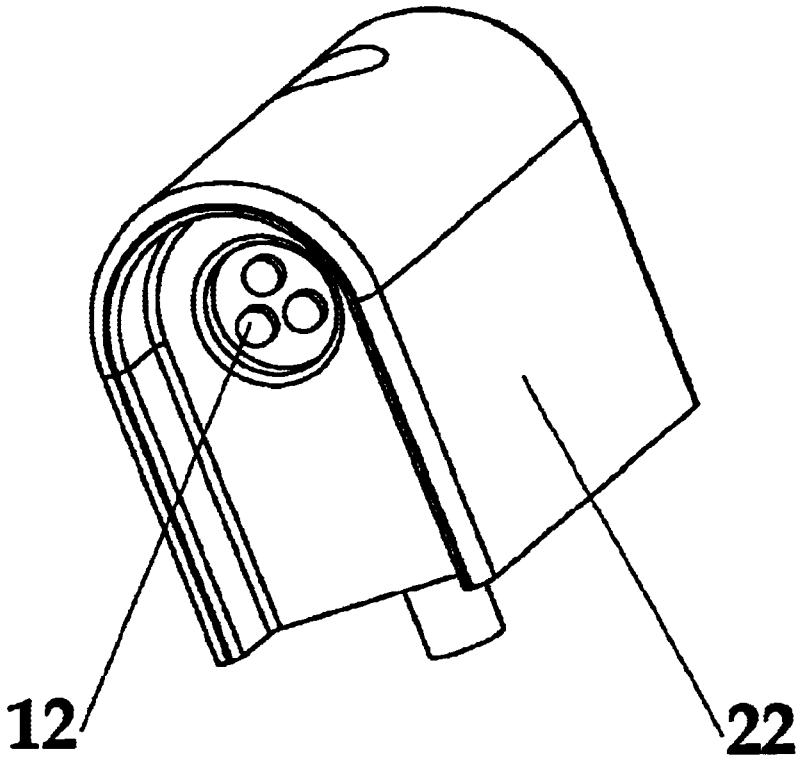

Referring to FIGS. 8*a* and 8*b*, another embodiment of the lighting system 10 includes several LEDs 12 being grouped together and electrically connected to an electric insulated wire having a negative lead 14, a resistor 16, and a positive lead 17 as previously described in the first embodiment. The LEDs 12 are held in place by a disk mount 54. Referring also to FIGS. 9*a*, 9*b*, and 9*c*, the electrical component assembly 23 is then pressed into the housing 22, which may have a variety of shapes. Once the assembly 23 is pressed into the housing 22, epoxy is poured into the housing 22 at the bottom portion of the housing 22 in order to permanently seal and unitize the circuitry and LEDs 12 with the housing 22.

Figure 10:
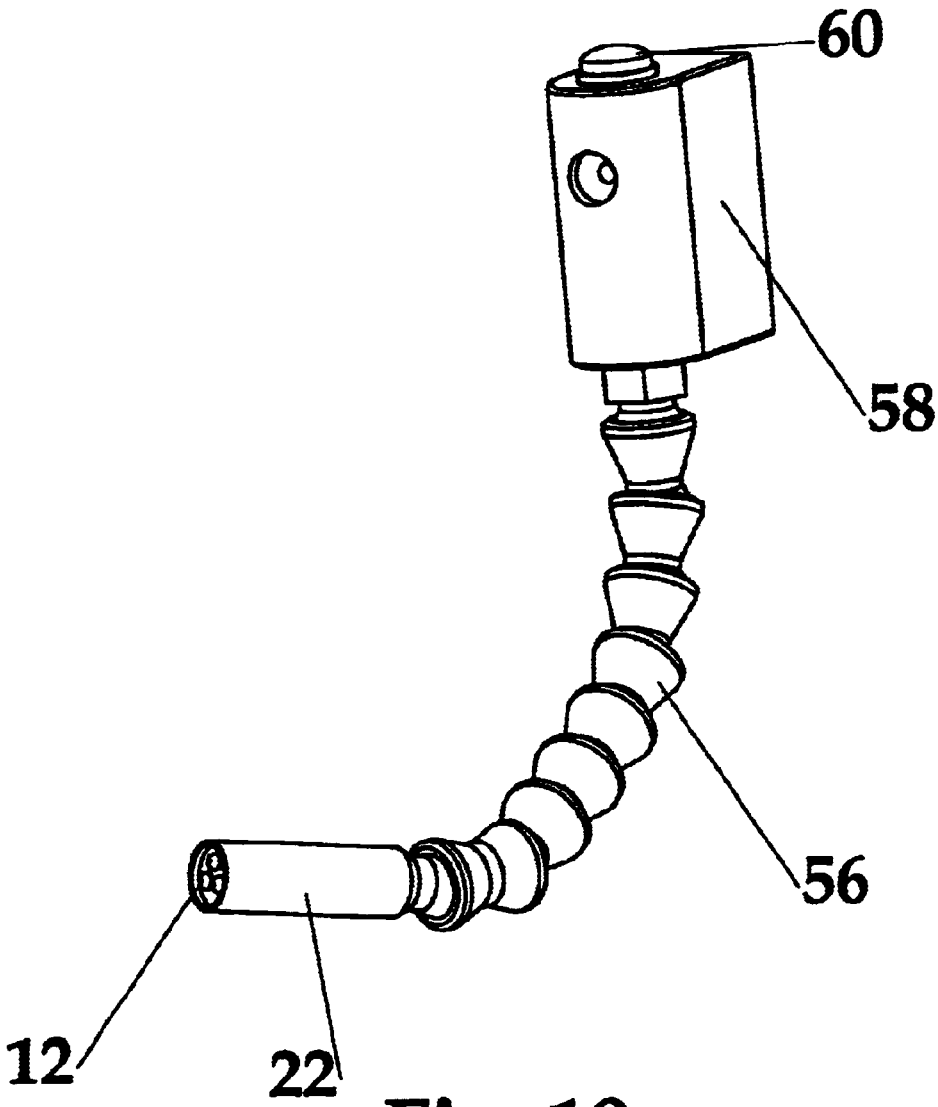
FIG. 10 is a pictorial view of a lighting system of this invention connected to a fixture via a flexible stalk member.

Referring to FIG. 10, the lighting system 10 with a single LED or several LEDs 12 may also be connected via a flexible stalk member 56 to a fixture portion 58. The fixture portion 58 secures the lighting system 10 to a variety of vertical or horizontal surfaces. The fixture portion 58 may optionally include a switch 60.

Although the invention has been described with respect to various embodiments, it should be realized this invention is also capable of a wide variety of further and other embodiments within the spirit and scope of the invention.

What is claimed is:

1. A miniature lighting system, comprising:

an opaque housing having a top portion and a bottom portion, said top portion including an opening and an inside surface;

a light source located in said opening of said top portion of said housing for providing illumination to a region external to said housing through said opening;

an electrical component assembly comprising a first electric insulated wire having a negative lead connected to said light source, a resistor connected to said light source, and a second electric insulated wire having a positive lead connected to said resistor, said electrical component assembly located within said housing;

a sealant surrounding said electrical component assembly within said housing, said sealant affixing said electrical component assembly within said housing; and a means for preventing said sealant from exiting said opening.

2. The miniature lighting system of claim 1 wherein said light source is a light emitting diode.

3. The miniature lighting system of claim 1 further comprising a diffusing lens, said diffusing lens being affixed to said top portion of said opaque housing.

4. The miniature lighting system of claim 1 wherein said electrical component assembly is surrounded by shrink-tube.

5. The miniature lighting system of claim 1 wherein said opaque housing is comprised of a stainless steel material.

6. The miniature lighting system of claim 1 further comprising a power source transferring electrical power to said electrical component assembly.

7. The miniature lighting system of claim 6 further comprising a photocell.

8. The miniature lighting system of claim 1 further comprising a handrail mounting base, said opaque housing being embedded within a preselected portion of said handrail mounting base such that a surface of the handrail is externally illuminated.

9. The miniature lighting system of claim 1 further comprising an outer housing, said outer housing having a top portion and a bottom portion wherein said opaque housing is removably located within said outer housing.

10. The miniature lighting system of claim 1 wherein said inside surface of said opaque housing is chamfered.

11. The miniature lighting system of claim 1 wherein said light source comprises a plurality of light emitting diodes.

12. The miniature lighting system of claim 6 further comprising a switch controlling the transfer of said power to said electrical component assembly.

13. The miniature lighting system of claim 1 further comprising a disk mount which secures said light source within said top portion of said opaque housing and seals said housing.

14. The miniature lighting system of claim 13 wherein said light source comprises a plurality of light emitting diodes.

15. The miniature lighting system of claim 13 further comprising a fixture portion which secures the lighting system to a surface.

16. The miniature lighting system of claim 15 further comprising a flexible stalk member disposed between said fixture portion and said housing.

17. The miniature lighting system of claim 15 wherein said fixture portion comprises a casing and a switch.

18. The miniature lighting system of claim 2, wherein the light emitting diodes operates nominally at 20 milliamps.

19. The miniature lighting system of claim 6, further comprising a timer controlling the application of power from the power source to the electrical component assembly.

20. The miniature lighting system of claim 6, wherein the power source comprises one or more solar-charged batteries.

* * * * *